United States Patent [19]

Ellis et al.

[11] 3,971,285

[45] July 27, 1976

[54] ADJUSTABLE MUZZLE COMPENSATOR

[75] Inventors: Paul H. Ellis; Richard R. Kramer, both of Bel Air, Md.

[73] Assignee: The United States of America as represented by the Secretary of the Army, Washington, D.C.

[22] Filed: Mar. 31, 1975

[21] Appl. No.: 563,543

[52] U.S. Cl. ..... 89/14 C
[51] Int. Cl.[2] ..... F41C 21/18
[58] Field of Search ..... 89/14 R, 14 B, 14 C, 89/14 D

[56] References Cited

UNITED STATES PATENTS 2,852,983 9/1958 Netzer ..... 89/14 C

*Primary Examiner*—Stephen C. Bentley
*Attorney, Agent, or Firm*—Nathan Edelberg; Robert P. Gibson; Saul Elbaum

[57] ABSTRACT

A compensator adapted to be mounted to a muzzle having a resilient arm for locking a gas diverter in a first and second radial position to compensate for normal muzzle climb for right and left handed use, respectively.

7 Claims, 3 Drawing Figures

ADJUSTABLE MUZZLE COMPENSATOR

RIGHTS OF THE GOVERNMENT

The invention described herein may be manufactured, used and licensed by or for the United States Government for governmental purposes without the payment to us of any royalty thereon.

BACKGROUND OF THE INVENTION

1. Field of the Invention

The present invention relates generally to muzzle compensators and more specifically to a muzzle compensator which is readily adjustable for right and/or left handed use without the use of special purpose tools.

2. Description of the Prior Art

In the field of weaponry, a muzzle compensator is needed to inhibit muzzle climbing during automatic weapon fire. Since the muzzle normally climbs up and to the right for the right-handed shooter and up and to the left for a left-handed shooter, it is important that the muzzle compensator be capable of accurate orientation for optimum compensation.

Generically, muzzle compensators are devices which cause most of the propellant gases behind the projectile to be vented counter to the direction of muzzle climb. The muzzle compensators of the prior art are rotatably received on the end of the muzzle and use a jam-nut to retain it in any desirable orientation. Not only do the compensators of the prior art require a wrench or other special purpose tool to loosen the jam-nut to adjust the muzzle compensator, but the accuracy of alignment of the compensator lies within the skill of the person doing the adjustment. Since this generally occurs in the field, the compensator is not accurately aligned; thus, it is not as effective.

Thus, there exists a need for a muzzle compensator which is readily and accurately adjustable in the field to accommodate right or left-handed users without the use of any tools.

SUMMARY OF THE INVENTION

The present invention solves the problems of the prior art by providing a muzzle compensator which is quickly and easily positively indexed in either of two required positions without the use of tools. The compensator consists of a collar which is securely mounted to the muzzle having two index slots therein defining the two required positions for right or left-handed users. A generally cylindrical gas-diverter is rotatably receivable on the muzzle and extends past the end of the muzzle. A resilient locking arm is mounted to the diverter housing and interconnects the housing and the collar by lying in either of the indexing slots so as to lock the diverter housing in one of the two positions defined by the indexing slots. Channels provided in the exterior of the diverter housing accommodate the resilient arm and its body portion so that the diverter housing does not rotate relative to the resilient arm. The indexing slots on the collar are approximately 45° apart so as to allow adjustment of the gas diverter's apertures to rotate the effective vector of the diverted gas to compensate for the use by a right handed user to that of a left handed user or vice versa.

OBJECTS OF THE INVENTION

It is an object of the present invention to provide a gas diverter which achieves re-orientation in the field by the shooter without the use of special tools.

Another object is to provide a gas diverter which is positively indexed in two specific orientations for accurate compensation for right or left handed users.

A further object of the invention is a muzzle compensator which is easily installed to muzzles of weapons without modifying or machining the weapon in any way.

Other objects, advantages and novel features of the present invention will become apparent from the following detailed description of the invention when considered in conjunction with the accompanying drawings.

DESCRIPTION OF THE PREFERRED EMBODIMENTS

Figure 1:
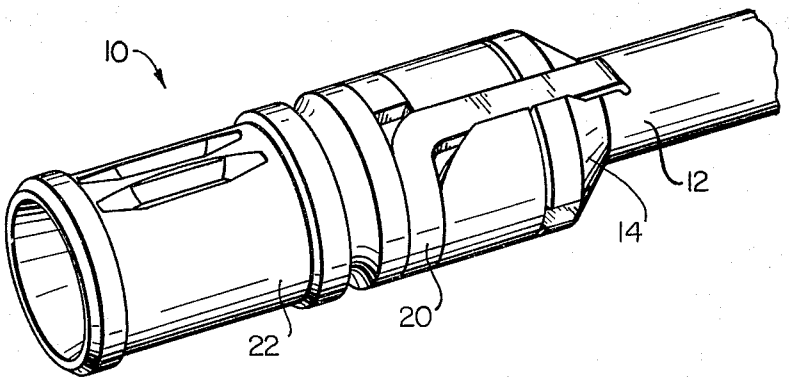
FIG. 1 is a perspective view of a preferred embodiment of the adjustable muzzle compensator of the present invention as mounted to a muzzle of a weapon.
Figure 2:
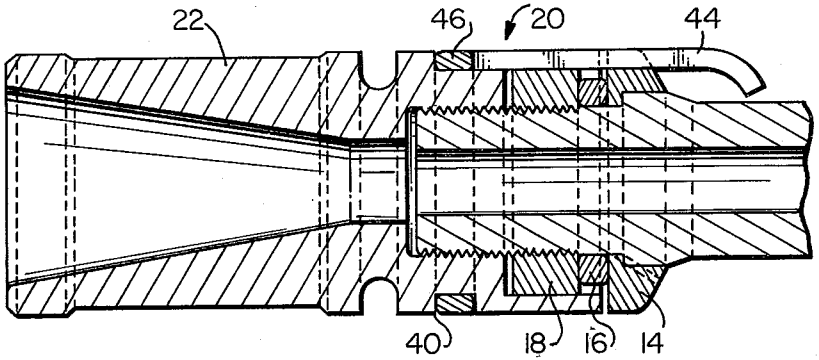
FIG. 2 is a side elevation of the embodiment of FIG. 1 having sections cut-away for clarity.
Figure 3:
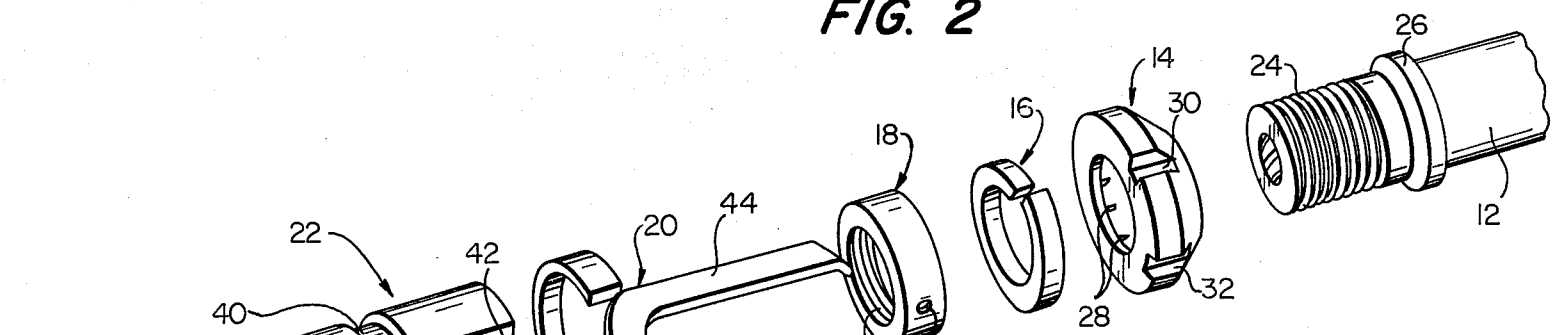
FIG. 3 is an exploded view of the adjustable muzzle compensator embodiment of FIG. 1.

The muzzle compensator, which will be designated 10, is shown mounted to a muzzle 12 of a weapon. The muzzle compensator 10 includes five parts which are: the indexing collar 14, lock washer 16, retaining nut 18, locking spring 20 and diverter housing 22. The muzzle 12 as shown in FIG. 3 includes a threaded section 24 and a shoulder 26.

The indexing collar 14 has a plurality of sharp internal ridges 28 that engage onto the shoulder 26 of the weapon's muzzle and prevent relative rotational movement between the muzzle and the indexing collar 14. The two indexing slots 30 and 32 are located on the external surface of the indexing collar 14 to mate with the rear portion of the locking spring 20. Once the indexing collar has been properly installed by an armorer, the two indexing slots 30 and 32 provide positive reference for the right or left-handed orientation for the gas diverter housing. Each slot may be appropriately labelled with the words "right" or "left".

The retaining nut 18 has an internally threaded section 34 of a cylinder with two holes 36 drilled in it along a diameter to mate with a spanner wrench. The retaining nut 18, in combination with the locking washer 16, forces the index collar 14 onto the shoulder 26 of the weapon's muzzle 12. Once the collar 14 has been forced into place, the retaining nut 18 prevents it from moving laterally.

The diverter housing 22 consists of a cylindrical section of steel with the same inside configuration as the standard flash suppressor. The outside configuration has been changed from the standard flash suppressor by machining a plurality of apertures 38 to allow the gas from the muzzle to be diverted in a preselected radial direction. Though the present device shows two slots 38, it is well within the present invention for any number of slots to be used, as long as the resulting vector of the diverting gas is counter to the normal direction of muzzle climb. The rear portion of the diverter housing 22 is machined to provide a radial channel 40 and a longitudinal channel 42 for the body and arm of the locking spring 20, respectively.

The locking spring 20 includes an arm portion 44 and a circular body portion 46. As assembled, the body portion 46 of locking spring 20 wraps around the diverter housing 22 and lies within the radial channel 40 while the arm 44 of the locking spring 20 lies in longitudinal channel 42 of the diverter housing 22 and extends past the locking housing 22 so that it can be snapped into one of the two indexing slots 30 or 32 of the indexing collar 14. With the arm 44 lying within the channel 42 of the diverter housing 22, the diverter housing and the locking spring are prevented from rotating relative to each other. Thus, the housing follows the locking spring when arm 44 is adjusted between indexing slots 30 and 32 or from 32 to 30.

The adjustable muzzle compensator 10 is installed by slipping indexing collar 14 over the threaded portions 24 of the muzzle 12, while maintaining its orientation with the sights established by the use of a jig. The locking washer 16 is then installed followed by the retaining nut 18 which is tightened with a spanner wrench being inserted in the holes 36. Next the diverter housing 22, with locking spring 20 snapped in place in channels 40 and 42, is screwed onto the muzzle as far rearward as it will go and still have the locking spring 20 fall into the correct slots 30 or 32. The installation of the adjustable muzzle compensator 10 can be retrofitted by the armorer or factory assembled on new weapons. The initial orientation would be for right-handed shooters since they do comprise a majority of the military population. Left-handed shooters would have only to lift arm 44 of locking spring 20 out of the slot 30 or 32 on the indexing collar 14 and rotate the diverter housing 22 until the arm 44 snaps into the left-handed orientation slot on the indexing collar 14. Lifting arm 44 may be done using almost any small object, such as a cartridge, projectile nose, bayonet point, nail, etc.

The indexing slots 30 and 32 of indexing collar 14 are shown as approximately 45° apart and are specifically 40° apart. This specific angular separation of the two slots was designed for a specific weapon having a specific re-coil. It should be noted that the specific angular relationship of the indexing slots, as well as the number and location of the gas diverting apertures 38 in the diverter housing 22 is a function of the design of the weapon, the projectile used and the amount of exiting gas that may be captured and diverted. The general concept of operation and design of the present device is that the indexing slots 30 and 32 provide positive and accurate indexing of the gas diverting slots 38 such that the resultant vector produced by the diverting gas is counter to the normal direction of muzzle climb. Since the direction of muzzle climb is a function of the weight of the weapon, the mass of the projectile, the velocity of the projectile and the propellant gases, etc., the present disclosure should not be limited to the specific angular relationship disclosed for slots 30 and 32 and the number of slots or their angular relationships.

From the preceding description of the preferred embodiments, it is evident that the objects of the invention are attained to provide an easily adjustable muzzle compensator with accurate and positive indexing. We wish it to be understood that we do not desire to be limited to the exact details of the construction shown and described, for obvious modifications can be made by persons skilled in the art.

What is claimed is:

1. A device to be mounted on a muzzle of a weapon comprising:

a collar means adapted to be secured to said muzzle having two indexing slots for defining two radial positions on said muzzle, said collar means including a plurality of internal radial ridges for engaging said muzzle and preventing rotational movement of the collar relative to the muzzle;

gas diverter means adapted to be rotatably connected to the muzzle and to extend beyond the end of the muzzle for diverting gases exiting said muzzle to a preselected radial direction; and locking means interconnecting said collar means and said gas diverter means for locking said gas diverter means in one of the two radial positions defined by said collar means.

2. The device of claim 1 wherein said locking means is mounted to said gas diverter means for rotation with said gas diverter means and said locking means includes a resilient arm extending between said gas diverter means for locking said gas diverter means in one of the two radial positions by occupying one of said two indexing slots.

3. The device of claim 2 wherein said gas diverter means comprises a generally cylindrical housing having an exterior longitudinal channel, and said resilient arm rests in said longitudinal channel.

4. The device of claim 3 wherein said cylindrical housing includes an exterior circumferal channel, and said locking means includes a body portion from which said arm extends and said body portion rests in said circumferal channel.

5. The device of claim 1 wherein said two radial positions are approximately 45° apart.

6. The device of claim 1 wherein said gas diverter means includes a plurality of radial apertures through which said diverted gases pass.

7. A device to be mounted on a muzzle of a weapon comprising:

collar means adapted to be secured to the muzzle and having a plurality of indexing slots for defining a plurality of radial positions on said muzzle;

gas diverter means adapted to be rotatably connected to the muzzle and to extend beyond the end of the muzzle for diverting gases exiting said muzzle to a preselected radial direction, said gas diverter means comprising a generally cylindrical housing having an exterior circumferential channel and an exterior longitudinal channel; and locking means interconnecting said collar means and gas diverter means for locking said gas diverter means in one of said radial positions comprising a resilient member having a body portion resting in said circumferential channel and a resilient arm extending from said body portion resting in said longitudinal channel, said resilient member locking said gas diverter means in one of said radial positions by occupying one of said indexing slots.

* * * * *